US011722808B2

(12) United States Patent
Lin

(10) Patent No.: US 11,722,808 B2
(45) Date of Patent: Aug. 8, 2023

(54) MICRO-FILTER AND ACOUSTIC DEVICE

(71) Applicant: Weifang Goertek Microelectronics Co., Ltd., Shandong (CN)

(72) Inventor: Yujing Lin, Shandong (CN)

(73) Assignee: Weifang Goertek Microelectronics Co., Ltd., Shandong (CN)

( * ) Notice: Subject to any disclaimer, the term of this patent is extended or adjusted under 35 U.S.C. 154(b) by 0 days.

(21) Appl. No.: 17/623,304

(22) PCT Filed: Jul. 5, 2019

(86) PCT No.: PCT/CN2019/094776
§ 371 (c)(1),
(2) Date: Dec. 28, 2021

(87) PCT Pub. No.: WO2020/258363
PCT Pub. Date: Dec. 30, 2020

(65) Prior Publication Data

US 2022/0377442 A1 Nov. 24, 2022

(30) Foreign Application Priority Data

Jun. 28, 2019 (CN) ..... 201910579444.8

(51) Int. Cl.
*H04R 1/02* (2006.01)
*H04R 1/08* (2006.01)

(52) U.S. Cl.
CPC ..... *H04R 1/023* (2013.01); *H04R 1/086* (2013.01); *H04R 2207/021* (2013.01)

(58) Field of Classification Search
CPC ... H04R 1/023; H04R 1/086; H04R 2207/021
See application file for complete search history.

(56) References Cited

U.S. PATENT DOCUMENTS

2020/0039816 A1* 2/2020 Zou ..... B81B 7/0061
2021/0078856 A1* 3/2021 Zou ..... B81B 3/0018

FOREIGN PATENT DOCUMENTS

CN 1901758 A 1/2007
CN 109379684 A 2/2019
CN 109536748 A 3/2019
CN 109890748 A 6/2019

OTHER PUBLICATIONS

"Glass Transition Temperature", Rotational Molding Technology, https://www.sciencedirect.com/topics/materials-science/glass-transition-temperature, 2002 (Year: 2002).*

* cited by examiner

*Primary Examiner* — Sunita Joshi
(74) *Attorney, Agent, or Firm* — Baker Botts LLP

(57) ABSTRACT

Disclosed is a micro-filter comprising a substrate with a back cavity and a film layer provided on the substrate and suspended above the back cavity; the film layer has through holes distributed thereon, and is made of an amorphous metal film. Also disclosed is an acoustic device comprising the micro-filter.

18 Claims, 3 Drawing Sheets

MICRO-FILTER AND ACOUSTIC DEVICE

CROSS-REFERENCE TO RELATED APPLICATIONS

This application is a National Stage of International Application No. PCT/CN2019/094776, filed on Jul. 7, 2019, which claims priority to Chinese Patent Application No. 20191057444.8, filed Jun. 28, 2019, both of which are hereby incorporated by reference in its entirety.

TECHNICAL FIELD

The present disclosure relates to a micro-filter, which may be a micro-filter suitable for an acoustic device so as to filter substances such as dust, particles or/and water that are not desired to enter into the interior of the acoustic device.

BACKGROUND

Portable computing devices such as laptops and tablets are ubiquitous, and so are portable communication devices such as smart phones. However, such devices lack enough room to accommodate a relatively large microphone or speaker. As a result, microphones and speakers are decreasing in size and are becoming more and more compact. In addition, microphones and speakers in such portable devices often need to be close to relevant acoustic input or output ports of a terminal and thus tend to cause failure of these acoustic devices due to particle or water ingress of the microphones and speakers.

A filter film was sometimes deployed in a prior art device to prevent certain types of debris from entering components thereof. Unfortunately, such filters tend to adversely affect operation of the microphone. For example, performance of a microphone is sometimes significantly degraded when such prior art methods are used. Customers of the microphone often choose not to use such microphones in their applications due to the degraded performance.

Ordinary metal films have stress limits when making a filter film. When an ordinary metal film is under stress and exhibits compression that forms a corrugation, the pressure cannot be detected with all optical automatic detection device. In order to fabricate the filter chip structure, a film with low tensile stress is required when depositing a suitable thin metal film onto the substrate. A film without low tensile stress tend to peel, crack, crepe or otherwise detach from its substrate, inevitably resulting in frequent disposal of PB chips after putting into operation.

In addition, since an ordinary metal film is of limited strength, there is a contradiction between maintaining the strength of the film and opening holes thereon. For example, a thick film layer is necessary in order to increase the strength, however, this results in increased depth of holes opened thereon, leading to relatively large acoustic resistance and is not conducive to the performance of the acoustic device.

SUMMARY

An object of the present disclosure is to provide a new technical solution of a micro-filter.

According to a first aspect of the present disclosure, a micro-filter is provided, comprising a substrate with a back cavity and a film layer provided on the substrate and suspended above the back cavity; the film layer has through holes distributed thereon, and is made of an amorphous metal film.

Optionally, the amorphous metal film is metallic glass.

Optionally, the metallic glass has a glass transition temperature Tg of 150° C. or higher.

Optionally, the metallic glass has a glass transition temperature Tg of 250° C. or higher.

Optionally, the through holes in the film layer have an inner diameter of 1 nm to 100 μm.

Optionally, the through holes in the film layer have an inner diameter of 5 nm to 10 μm.

Optionally, the film layer has a thickness of 5 nm to 5 μm.

Optionally, the film layer has a thickness of 20 nm to 1000 nm.

Optionally, the substrate is made of polymer material, metal, silicon or $SiO_2$.

According to another aspect of the present disclosure, an acoustic device is provided, comprising the above micro-filter.

Optionally, the acoustic device is a microphone module or a microphone chip.

According to an embodiment of the present disclosure, by using the metallic glass as the film layer of the micro-filter, it is possible to increase the open porosity of the film layer while ensuring strength of the film layer, reduce the thickness of the film layer, make the permeation treatment easy and form smaller through holes, thereby avoiding the acoustic resistance of relatively thick traditional films after being opened due to the relatively large depth of the holes.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which are incorporated in the description and constitute a part of the description, illustrate embodiments of the present disclosure and, together with the description thereof, serve to explain the principles of the present disclosure.

DETAILED DESCRIPTION

Figure 1:
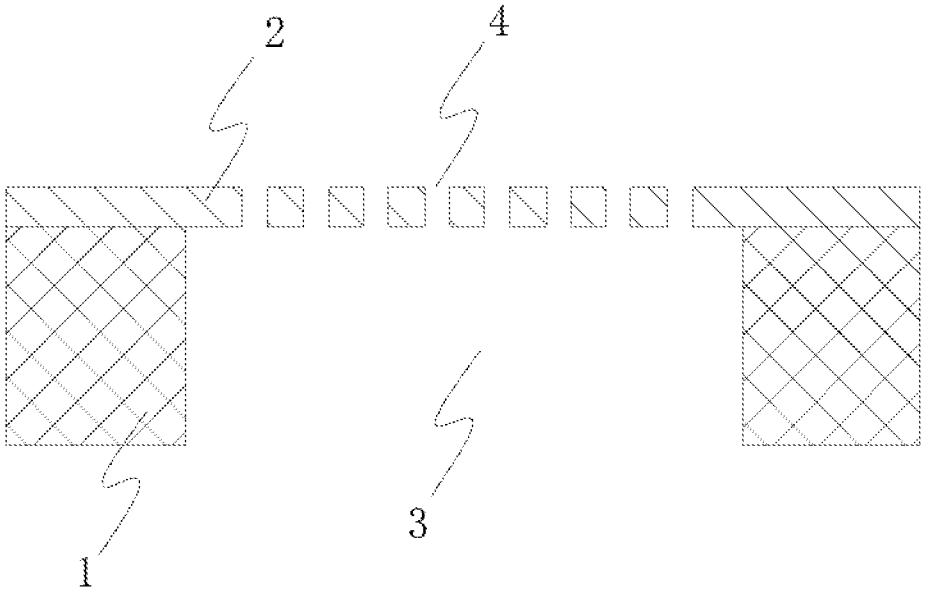
FIG. 1 is a cross-sectional view of a first embodiment of the micro-filter of the present disclosure.

Various exemplary embodiments of the present disclosure will now be described in detail with reference to the accompanying drawings. It should be noted that the relative arrangement, numerical expressions and numerical values of the components and steps set forth in these examples do not limit the scope of the disclosure unless otherwise specified.

The following description of at least one exemplary embodiment is in fact merely illustrative and is in no way intended as a limitation to the present disclosure and its application or use.

Techniques, methods, and apparatuses known to those of ordinary skill in the art may not be discussed in detail but where appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in accompanying drawings, and therefore, once an item is defined in a drawing, and there is no need for further discussion in the subsequent accompanying drawings.

The micro-filter provided by the present disclosure includes a substrate and a film layer provided on the substrate. The substrate has a hollow back cavity structure and is connected to the edge of the film layer, wherein the middle area of the film layer is suspended above the back cavity, so that the film layer constitutes a cantilever bridge structure.

FIG. 1 shows a schematic structural diagram of one embodiment of the micro-filter of the present disclosure. Referring to FIG. 1, a film layer 2 is connected to the upper part of a substrate 1 and is suspended above a hollow back cavity 3 of the substrate 1. The film layer 2 has through holes 4 for air to pass through. The substrate 1 may be made of metal, silicon or $SiO_2$, and the hollow back cavity 3 may be formed in a manner well known to those skilled in the art. For example, the hollow back cavity 3 is formed by a process such as etching, which will not be described in detail herein.

The film layer 2 may be a non-metallic film, such as polyimide material, $SiO_2$, SiN, etc. The film layer 2 may alternatively be a metal film, such as a crystalline film containing Cr, Al, Ti, or Cu.

The present disclosure preferably adopts an amorphous metal film, such as metallic glass. The amorphous metal films may be formed by ultra-rapid cooling, physical vapor deposition, electroplating, pulsed laser deposition, solid-state reaction, ion radiation, or mechanical alloying, which belong to the common knowledge of those skilled in the art and will not be described in detail herein.

Since the metallic glass has irregular atomic arrangement but no specific slip plane, it has higher strength than crystalline metal, and has excellent fatigue performance and elastic deformation to resist deformation. Metallic glass has an elastic modulus about one third of that of crystalline metal and a tensile strength three times that of crystalline metal. For example, Mg alloy has strength of 300 MPa, Mg base glass has strength of 800 MPa, FeCoBSiNb metal glass has strength of 4400 MPa, and SUS304 stainless steel has strength of 1400 MPa.

Therefore, with metallic glass as the film layer of the micro-filter, it is possible to increase the open porosity of the film layer and reduce the thickness of the film layer while ensuring the strength of the film layer, facilitating simplify of the permeation treatment and forming of smaller through holes, thereby avoiding the acoustic resistance of relatively thick traditional films due to the relatively large depth of the through holes opened thereon.

In an alternative embodiment of the present disclosure, the through holes 4 in the film layer 2 may have an inner diameter of 1 nm to 100 μm.

In an alternative embodiment of the present disclosure, the through holes 4 in the film layer 2 may have an inner diameter of 5 nm to 10 μm.

In an alternative embodiment of the present disclosure, the film layer has a thickness of 5 nm to 5 μm.

In an alternative embodiment of e present disclosure, the film layer 2 has a thickness of 20 nm to 1000 nm.

Since the metallic glass is an amorphous material, it is isotropic and uniform. In addition, there are basically no defects caused by such as grain boundaries and segregation of a polycrystalline structure, and the size effect is small. Therefore, when designing a micro-filter, it is not necessary to consider changes in physical properties due to anisotropy and size, which is beneficial to designing the structure of the micro-filter. In addition, since metallic glass is an alloy composed of multiple elements, it is possible to broaden the range of materials to be selected when designing the micro-filter, and design and manufacture a PB chip with higher performance.

For example, the metallic glass may contain multiple transition metal elements, and may optionally contain one or more non-metal elements. The metallic glass containing the transition metal elements may have at least one of Sc, Y, La, Al, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd and Hg. Depending on the application, any suitable transition metal elements or combination thereof may be used. Any suitable non-metallic elements or combination thereof may be used. For example, non-metal elements may be any one of F, Cl, Br, I, At, O, S, Se, Te, Po, N, P, As, Sb, Bi, C, Si, Ge, Sn, Pb and B.

In an alternative embodiment of the present disclosure, the metallic glass has a glass transition temperature Tg of 150° C. or higher.

In an alternative embodiment of the present disclosure, the metallic glass has a glass transition temperature Tg of 250° C. or higher.

In the micro-filter of the present disclosure, there may be provided with one layer, or two, three or more layers of the film layer 2.

Figure 2:
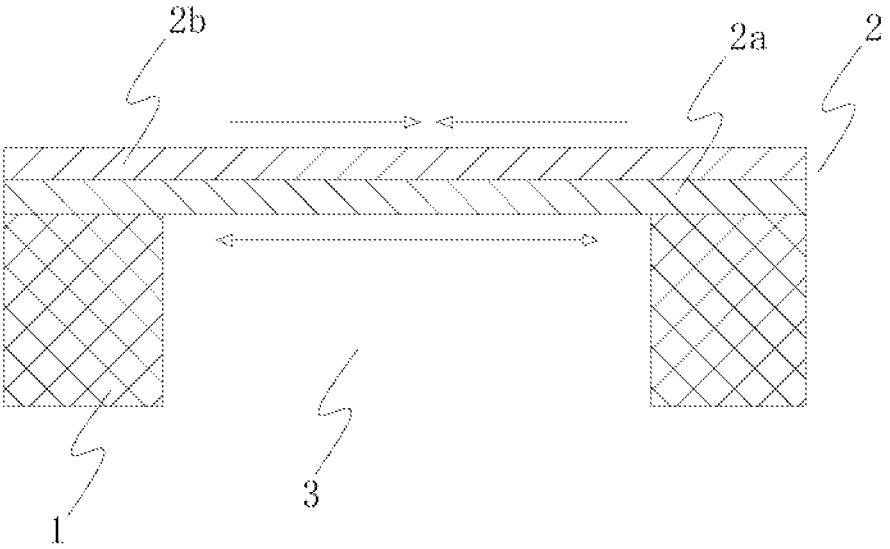
FIG. 2 is a cross-sectional view of a second embodiment of the micro-filter of the present disclosure.
Figure 3:
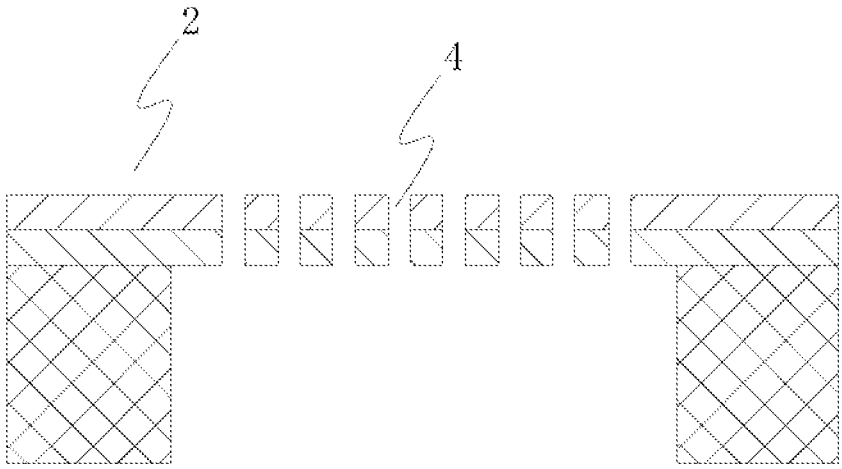
FIG. 3 is a cross-sectional view of the second embodiment of the micro-filter of the present disclosure from another perspective.

Referring to FIGS. 2 and 3, the film layer includes a first diaphragm 2*a* and a second diaphragm 2*b* that are integrated together. Wherein, the first diaphragm 2*a* has a tensile stress, and the second diaphragm 2*b* has a compressive stress. After the first diaphragm and the second diaphragm are compounded together, the stress of the entire film layer 2 is reduced under the interaction of the tensile stress and the compressive stress, so that the entire film layer 2 may be placed on the substrate 1 evenly and smoothly.

The first diaphragm 2*a* and the second diaphragm 2*b* may be made of the same material or different materials. For example, the first diaphragm 2*a* and the second diaphragm 2*b* may be selected from a crystalline metal film, an amorphous metal film or a non-metal film. In order to improve the elasticity and impact resistance of the film layer 2, at least one diaphragm in the film layer 2 is the amorphous metal film.

The diaphragm may exhibit various internal stresses, such as the tensile stress and the compressive stress, depending on the deposition conditions and deposition thickness of the film. The internal stress of the diaphragm may greatly change the performance of the diaphragm, such as mechanical properties. Therefore, by compounding the diaphragm with the tensile stress and the diaphragm with the compressive stress, it is possible to eliminate the internal stress of the diaphragm and adjust the internal stress thereof to a desired stress range.

For example, in an alternative embodiment, the stress of the film layer 2 is controlled between −300 MPa (compressive stress) and 300 MPa (tensile stress).

For example, in an alternative embodiment, the stress of the film layer 2 is controlled between 0 and 300 MPa (tensile stress). By controlling the film layer 2 at a lower tensile stress, the film layer 2 may be in a tensioned state and maintain its own shape, which is beneficial to the flatness of the diaphragm 2 on the substrate 1 for optical automatic monitoring.

In an alternative embodiment, the second diaphragm 2*b* is provided adjacent to the substrate 1 relative to the first diaphragm 2*a*. The second diaphragm 2*b* with compressive stress is provided on the side adjacent to the substrate 1, and the first diaphragm 2*a* with tensile stress is used to offset the compressive stress of the second diaphragm 2*b*.

In an alternative embodiment, the first diaphragm 2*a* is provided adjacent to the substrate 1 relative to the second diaphragm 2*b*. The first diaphragm 2*a* with tensile stress is provided on the side adjacent to the substrate 1, and the second diaphragm 2*b* with compressive stress is used to offset the tensile stress of the first diaphragm 2*a*; and since the first diaphragm 2*a* itself has tensile stress, it is possible to further avoid problems such as separation of the first diaphragm 2*a* from the substrate 1.

Figure 4:
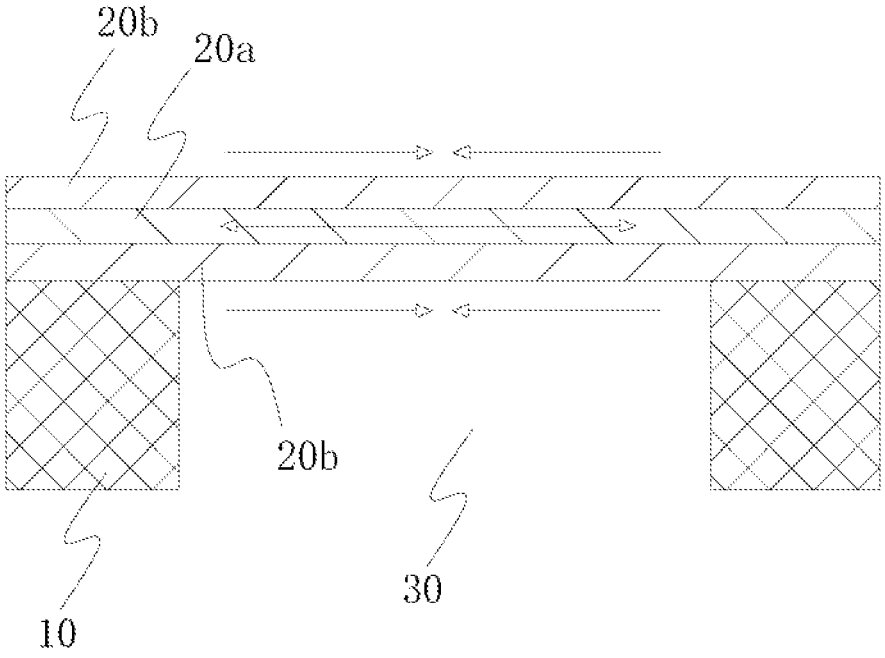
FIG. 4 is a cross-sectional view of a third embodiment of the micro-filter of the present disclosure.

FIG. 4 shows a schematic structural diagram of another embodiment of the micro-filter of the present disclosure. Different from the embodiment shown in FIG. 2, the film layer on the substrate 10 includes a three-layer diaphragm that is suspended above the hollow back cavity 30 of the substrate 10. The three-layer diaphragm includes one layer of the first diaphragm 20*a* with tensile stress and two layers of the second diaphragms 20*b* with compressive stress. The first diaphragm 20*a* is located between the two layers of the second diaphragms 20*b*, and the three layers of diaphragms are compounded together. The second diaphragms with compressive stress located on both sides offset the tensile stress of the first diaphragm located in the middle; conversely, the first diaphragm with tensile stress located in the middle also offsets compressive stress of the second diaphragms on both sides, which will not be described in detail herein.

The three-layer diaphragm structure of the film layer may also include two layers of the first diaphragms 20*a* with tensile stress and one layer of the second diaphragm 20*b* with compressive stress. The second diaphragm 20*b* is located between the two layers of first diaphragm 20*a*.

Based on a similar principle, the first diaphragm and the second diaphragm in the film layer may be provided with a plurality of layers, for example, four layers, five layers or more. The first diaphragm and the second diaphragm are provided to be spaced apart from each other.

In an alternative embodiment of the present disclosure, the substrate is made of a photosensitive polymer material, and is shaped through an exposure process and a polymerization process. For example, in a specific embodiment of the present disclosure, the substrate may be made of epoxy resin or polyimide resin. Optionally, the epoxy resin and the polyimide resin are selected as dry film or liquid type.

The substrate is made of photosensitive polymer, for example, epoxy-based negative photoresist or photosensitive polyimide may be used, which makes the manufacturing, process easy.

For example, SU-8 is a commonly used epoxy-based negative photoresist. Negativity refers to the photoresist which the part exposed to UV becomes cross-linked, while the remaining part remains soluble and can be washed off during development.

Polyimide is a polymer of imide monomers. Polyimide has high heat resistance and has many applications in processes that require strong and durable organic materials. Polyimide may be used as photoresist, for example, "positive" and "negative" types of photoresist-batted polyimide.

The micro-filter may be manufactured on a wafer at the same time. For example, when manufacturing a micro-filter, first, a film layer may be formed on a base by deposition, etching and other processes; then, the photopolymer may be bonded as a substrate by laminating; subsequently, a substrate with a back cavity is termed by exposure and polymerization; finally, the film layer is separated from the substrate.

The metal film or polyimide film is carried on the substrate of the photosensitive material, and supports the film layer through the substrate, so that the micro-filter may be made small while ensuring its structure.

Figure 5:
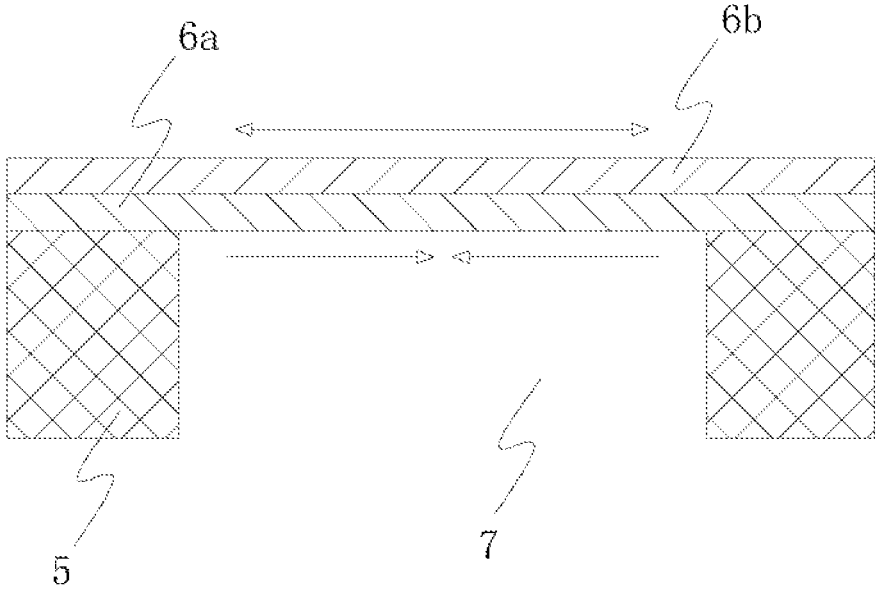
FIG. 5 is a cross-sectional view of a fourth embodiment of the micro-filter of the present disclosure.

FIG. 5 shows a schematic structural diagram of another embodiment of the micro-filter of the present disclosure. In the embodiment shown in FIG. 4, different from the embodiments shown in FIGS. 1, 2, 3, and 4, the metal film 6*a* is provided on the substrate 5 and is suspended above the hollow back cavity 7 of the substrate 5. The metal film 6*a* may be an amorphous metal film, for example, metallic glass. The substrate 5 may be made of polymer material, metal, silicon or $SiO_2$.

The outer surface of the metal film 6*a* is coated with a nonstick layer 6*b*. The adhesion between the nonstick layer 6*b* and the particles is lower than the adhesion between the metal film 6*a* and the particles; the metal film 6*a* and the nonstick layer 6*b* are arranged with through holes (not shown in the figures).

In an alternative embodiment of the present disclosure, the nonstick layer 6*b* is a silicone compound coating or a fluoropolymer coating.

In an alternative embodiment of the present disclosure, the nonstick layer 6*b* is a Teflon coating. Teflon has high temperature characteristic and a low coefficient of friction.

By providing a nonstick layer on the metal film, it is possible to avoid the problem of particles sticking to the metal film with through holes after long-term use, thereby ensuring the sensitivity of the sensor.

In an alternative embodiment of the present disclosure, the metal film 6*a* is configured to have compressive stress; the nonstick layer 6*b* is configured to have tensile stress; by compounding the metal film 6*a* and the nonstick layer 6*b* together, it is possible to reduce the stress of the entire film. Of course, it is also possible that the metal film 6*a* is configured to have tensile stress, and the nonstick layer 6*b* is configured to have compressive stress. The specific principle is the same as the embodiment shown in FIG. 2 and FIG. 4, and will not be described in detail herein.

For example, in an alternative embodiment, the stress of the composite film layers is controlled between −300 MPa (compressive stress) and 300 MPa (tensile stress).

For example, in an alternative embodiment, the stress of the composite film layers is cola trolled between 0 and 300 MPa (tensile stress).

Figure 6:
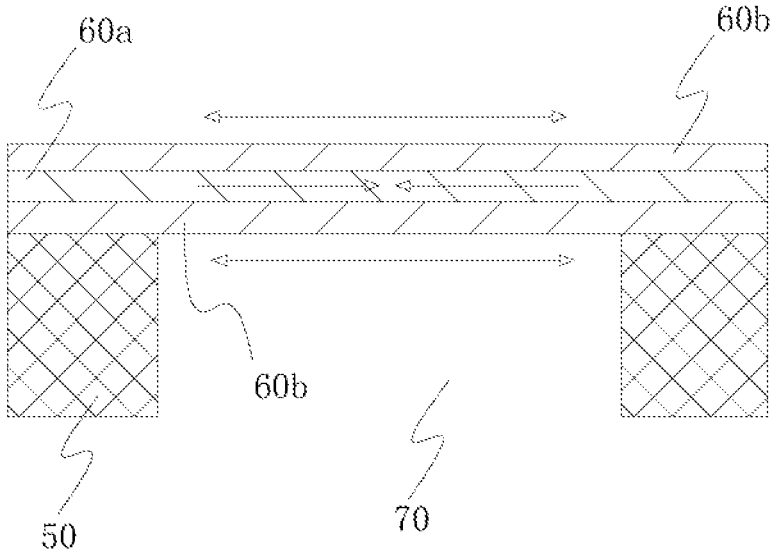
FIG. 6 is a cross-sectional view of a fifth embodiment of the micro-filter of the present disclosure.

FIG. 6 shows a schematic structural diagram of another embodiment of the micro-filter of the present disclosure. Different from the embodiment shown in FIG. 5, the film layer on the substrate 50 includes a three-layer diaphragm that is suspended above the hollow back cavity 70 of the substrate 50. The three-layer diaphragm includes one layer of the metal film 60*a* with compressive stress and two nonstick layers 60*b* with tensile stress. The metal film 60*a* is sandwiched between the two nonstick layers 60*b*, and the three layers are compounded together. The nonstick layers 60*b* with tensile stress located on both sides offset the compressive stress of the metal film located in the middle;

conversely, the metal film 60*a* with compressive stress located in the middle also offsets compressive stress of the nonstick layers 60*b* on both sides, which will not be described in detail herein.

In addition, the nonstick layers 60*b* are provided on both sides of the metal film 60*a*, so that particle adsorption of the metal film 60*a* may be avoided or reduced, thereby ensuring the performance of the micro-filter.

While certain specific embodiments of the present disclosure have been illustrated by way of example, it will be understood by those skilled in the art that the foregoing examples are provided for the purpose of illustration and are not intended to limit the scope of the present disclosure. It will be understood by those skilled in the art that the foregoing embodiments may be modified without departing from the scope and spirit of the disclosure. The scope of the present disclosure is subject to the attached claims.

The invention claimed is:

1. A micro-filter, comprising a substrate with a back cavity and a film layer provided on the substrate and suspended above the back cavity; wherein the film layer includes through holes distributed thereon, and is made of an amorphous metal film, and the film layer includes at least one first diaphragm with a tensile stress and at least one second diaphragm with a compressive stress, and the at least one first diaphragm and the at least one second diaphragm are integrated together and are provided to be spaced apart from each other.

2. The micro-filter of claim 1, wherein the amorphous metal film is metallic glass.

3. The micro-filter of claim 1, wherein the metallic glass has a glass transition temperature Tg of 150° C. or higher.

4. The micro-filter of claim 1, wherein the metallic glass has a glass transition temperature Tg of 250° C. or higher.

5. The micro-filter of claim 1, wherein the through holes in the film layer have an inner diameter of 1 nm to 100 μm.

6. The micro-filter of claim 5, wherein the through holes in the film layer have an inner diameter of 5 nm to 10 μm.

7. The micro-filter of claim 1, wherein the film layer has a thickness of 5 nm to 5 μm.

8. The micro-filter of claim 7, wherein the film layer has a thickness of 20 nm to 1000 nm.

9. The micro-filter of claim 1, wherein the substrate is made from a material selected from the group consisting of polymer material, metal, silicon or $SiO_2$.

10. An acoustic device, comprising the micro-filter of claim 1.

11. The acoustic device of claim 10, wherein the acoustic device is a microphone module or a microphone chip.

12. The micro-filter of claim 1, wherein the film layer has a tensile stress controlled between 0 and 300 MPa.

13. The micro-filter of claim 1, wherein the film layer includes one first diaphragm with the tensile stress and one second diaphragm with the compressive stress, and the first diaphragm is provided adjacent to the substrate relative to the second diaphragm.

14. The micro-filter of claim 1, wherein the film layer includes a three-layer diaphragm which includes one layer of the first diaphragm with the tensile stress and two layers of the second diaphragms with the compressive stress, and the first diaphragm is located between the two layers of the second diaphragms.

15. The micro-filter of claim 1, wherein the film layer includes a three-layer diaphragm which includes two layers of the first diaphragms with the tensile stress and one layer of the second diaphragm with the compressive stress, and the second diaphragm is located between the two layers of first diaphragm.

16. The micro-filter of claim 1, wherein the outer surface of the metal film is coated with a nonstick layer, the adhesion between the nonstick layer and particles is lower than the adhesion between the metal film and particles, and the metal film and the nonstick layer are arranged with through holes.

17. The micro-filter of claim 16, wherein the metal film is configured to have compressive stress, the nonstick layer is configured to have tensile stress, and the metal film and the nonstick layer are compounded together.

18. The micro-filter of claim 1, further including two nonstick layers with tensile stress which are provided on both sides of the metal film with compressive stress.

* * * * *